US009776340B2

(12) United States Patent
Kanbayashi

(10) Patent No.: US 9,776,340 B2
(45) Date of Patent: Oct. 3, 2017

(54) METHOD FOR SLICING INGOT AND WIRE SAW

(71) Applicant: SHIN-ETSU HANDOTAI CO., LTD., Tokyo (JP)

(72) Inventor: Keiichi Kanbayashi, Nishigo-mura (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 88 days.

(21) Appl. No.: 14/911,075

(22) PCT Filed: Jul. 24, 2014

(86) PCT No.: PCT/JP2014/003889
§ 371 (c)(1),
(2) Date: Feb. 9, 2016

(87) PCT Pub. No.: WO2015/029323
PCT Pub. Date: Mar. 5, 2015

(65) Prior Publication Data

US 2016/0176069 A1 Jun. 23, 2016

(30) Foreign Application Priority Data

Aug. 28, 2013 (JP) ..... 2013-177039

(51) Int. Cl.
*B28D 5/00* (2006.01)
*B28D 5/04* (2006.01)
*B24B 27/06* (2006.01)

(52) U.S. Cl.
CPC ..... *B28D 5/045* (2013.01); *B24B 27/0633* (2013.01); *B28D 5/0076* (2013.01); *B28D 5/0082* (2013.01)

(58) Field of Classification Search
CPC ..... B28D 5/04; B28D 5/045; B28D 5/0076; B28D 5/0082; B28D 5/00
(Continued)

(56) References Cited

U.S. PATENT DOCUMENTS 5,937,844 A * 8/1999 Kiuchi ..... B28D 5/0064 125/16.02
9,079,332 B2 * 7/2015 Kitagawa ..... B23D 59/001
(Continued)

FOREIGN PATENT DOCUMENTS

CN 101622098 A 1/2010
CN 10217993 A 9/2011
(Continued)

OTHER PUBLICATIONS

Dec. 2, 2016 Chinese search Report issued in Chinese Patent Application No. 2014800457833.
(Continued)

*Primary Examiner* — Robert Rose
(74) *Attorney, Agent, or Firm* — Oliff PLC

(57) ABSTRACT

A method is disclosed for slicing an ingot by which wire rows are formed by using a wire that is spirally wound between a plurality of wire guides and travels in an axial direction. An ingot is pressed against the wire rows while supplying a working fluid to a contact portion of the ingot and the wire, thereby slicing the ingot into wafers, and a ratio of a wire new line feed amount per unit time in slicing of a slicing start portion of a first ingot to that in slicing of a centration portion of the same at the time of slicing the ingot after replacement of the wire is controlled to be ½ or less of the ratio at the time of slicing second and subsequent ingots after the replacement of the wire.

2 Claims, 4 Drawing Sheets

(58) Field of Classification Search
USPC ..... 125/16.02, 16.01, 21; 451/168, 173, 296
See application file for complete search history.

(56) References Cited

U.S. PATENT DOCUMENTS

| | | | | |
|---|---|---|---|---|
| 9,174,361 | B2 * | 11/2015 | Blank | B28D 5/045 |
| 2008/0141994 | A1 * | 6/2008 | Skovgaard-Soerensen | B23D 57/0046 125/12 |
| 2010/0089377 | A1 | 4/2010 | Oishi et al. | |

FOREIGN PATENT DOCUMENTS

| | | | |
|---|---|---|---|
| CN | 102172933 | A | 9/2011 |
| CN | 102172993 | A | 9/2011 |
| CN | 202507408 | U | 10/2012 |
| DE | 19645013 | A1 | 5/1998 |
| JP | H10-86140 | A | 4/1998 |
| JP | 2000-042896 | A | 2/2000 |
| JP | 2000-141201 | A | 5/2000 |
| JP | 2007-276048 | A | 10/2007 |
| JP | 2008-188721 | A | 8/2008 |
| JP | 2012-106322 | A | 6/2012 |
| KR | 10-1064266 | B1 | 9/2011 |
| TW | 201119823 | A | 6/2011 |
| TW | 201213080 | A | 4/2012 |
| TW | 201311392 | A | 3/2013 |

OTHER PUBLICATIONS

Jan. 4, 2017 Taiwanese Office Action issued in Taiwanese Patent Application No. 103126238.
Oct. 14, 2014 International Search Report issued in International Patent Application No. PCT/JP2014/003889.

* cited by examiner

METHOD FOR SLICING INGOT AND WIRE SAW

TECHNICAL FIELD

The present invention relates to a method for slicing an ingot into a wafer shape by a wire saw and to a wire saw.

BACKGROUND ART

In recent years, an increase in size of a wafer has been demanded, and a wire saw is mainly used for slicing an ingot with this increase in size.

The wire saw is a device that allows a wire (a high tensile steel wire) to travel at high speed, presses a workpiece (there is, e.g., a silicon ingot. It may be simply referred to as an ingot hereinafter) against the wire while apply slurry to the wire, and slices the workpiece to provide many wafers at the same time (see Patent Literature 1).

Here, FIG. 4 shows an outline of an example of a conventional general wire saw.

As shown in FIG. 4, a wire saw 101 is mainly constituted of a wire 102 configured to slice an ingot, a wire guide 103 around which the wire 102 is wound, a tension imparting mechanism 104 configured to impart tension to the wire 102, ingot feeding means 105 for feeding the ingot to be sliced, a nozzle 106 configured to supply slurry provided by dispersing and mixing abrasive grains such as SiC fine powder in a coolant, and others.

The wire 102 is reeled out from one wire reel 107, and enters the wire guide 103 through the tension imparting mechanism 104 formed of a powder clutch (a constant torque motor 109), a dancer roller (a dead weight) (not shown), an others through a traverser 108. The wire 102 is wound around this wire guide 103 for approximately 300 to 400 times, and then taken up by a wire reel 107' through the other tension imparting mechanism 104'.

Further, the wire guide 103 is a roller provided by press-fitting a polyurethane resin around a steel cylinder and forming grooves on a surface thereof at a fixed pitch, and enables the wound wire 102 to be driven in a reciprocating direction by a drive motor 110 with a predetermined cycle.

Furthermore, the nozzle 106 is provided near the wire guide 103 and the wound wire 102, and the slurry can be supplied to the wire guide 103 and the wire 102 from this nozzle 106 at the time of slicing. Moreover, after the slicing, it is discharged as waste slurry.

Such a wire saw 101 is used, appropriate tension is applied to the wire 102 by using the tension imparting mechanism 104, the wire 102 is allowed to travel in the reciprocating direction by the drive motor 110, and the ingot is sliced while supplying the slurry, thus providing a desired sliced wafer.

At the time of repeatedly slicing a plurality of ingots by using the wire saw, according to a general ingot slicing method, slicing is carried out under conditions that a wire new line feed amount remains the same in slicing of all the ingots.

In general, a wire new line feed amount at a slicing start portion of the ingot and a wire new line feed amount at a slicing end portion of the same are values smaller than a wire new line feed amount at the time of slicing a central portion. It is to be noted that, in case of an ingot having a diameter of, e.g., 300 mm, the slicing start portion of the ingot is a portion that is 15 mm from a portion where the wire first touches an outer peripheral end of the ingot, and the ingot central portion corresponds to a portion that is 150 mm from the outer peripheral end.

Moreover, when a thickness distribution of a wafer sliced out from the ingot is confirmed, a thickness of the wafer at the slicing start portion of the ingot is smaller than that of the central portion. As described above, in slicing of the ingot using the wire saw, the slicing start portion has the smallest thickness. A difference between a thickness of the slicing start portion and a thickness of the central portion within a wafer surface will be referred to as thickness unevenness hereinafter.

A phenomenon that the thickness of the slicing start portion is reduced is caused due to a large wire diameter of the wire used in the slicing start portion. To decrease the wire diameter of the wire, abrading the wire can suffice. As a method for adjusting an abrasion amount of the wire, there is a method for changing a wire new line feed amount. The abrasion of the wire is reduced when the wire new line feed amount is increased, and the abrasion of the wire is increased when the wire new line feed amount is reduced.

Thus, as a method for eliminating a problem that the thickness of the slicing start portion is reduced, there is a method for reducing the wire new line feed amount at the time of slicing the slicing start portion, and hence the thickness unevenness can be decreased. Additionally, when the wire is wound back before slicing the ingot and an abraded portion that has been already used is used for slicing, the thickness unevenness can be reduced.

CITATION LIST

Patent Literature

Patent Literature 1: Japanese Unexamined Patent Application (Kokai) No. H 10-86140

SUMMARY OF INVENTION

Technical Problem

However, even if the thickness unevenness within the wafer surface, there is a difference of approximately 2 to 3 μm in thickness unevenness between wafers sliced out from a first ingot and second and subsequent ingots to be sliced after replacing the wire. The wafer sliced out from the first ingot to be sliced after replacing the wire has a smaller thickness in the slicing start portion in particular, and the difference in thickness unevenness becomes prominent.

This occurs due to a difference between a wire diameter of a first part of the wire used for slicing the first ingot after replacing the wire and a wire diameter of a first part of the wire used for slicing the second and subsequent ingots.

That is because the abraded part of the wire which has been already used for slicing the ingot is used at a slicing start position by winding back the wire before starting slicing the second and subsequent ingots, whereas a new wire which is not abraded at all is used at the slicing start position in slicing of the first ingot after replacing the wire. It is to be noted that, in slicing of the second and subsequent ingots, the wire diameter of the wire at the time of slicing the slicing start portion is basically fixed.

If preliminary slicing is performed to abrade the wire before slicing the first ingot after replacing the wire, the above-described problem can be solved, but this means that wasteful slicing is carried out and leads to a demerit in light of device productivity, and implementation is difficult. For the above-described reason, slicing of the first ingot after replacing the wire and slicing of the second and subsequent ingots can lead to a thickness unevenness difference, thereby resulting in a problem that a variation in thickness unevenness becomes considerable.

In view of the above-described problem, it is an object of the present invention to provide a method for slicing an ingot and a wire saw that suppress a variation in thickness unevenness of wafers sliced out from a first ingot and second and subsequent ingots after replacing a wire.

Solution to Problem

To achieve this object, according to the present invention, there is provided a method for slicing an ingot by which wire rows are formed by using a wire that is spirally wound between a plurality of wire guides and travels in an axial direction, and an ingot is pressed against the wire rows while supplying a working fluid to a contact portion of the ingot and the wire, thereby slicing the ingot into wafers, wherein a ratio of a wire new line feed amount per unit time in slicing of a slicing start portion of a first ingot to that in slicing of a centration portion of the same at the time of slicing the ingot after replacement of the wire is controlled to be ½ or less of the ratio at the time of slicing second and subsequent ingots after the replacement of the wire.

With this arrangement, it is possible to suppress a variation in thickness unevenness of wafers sliced out from the first ingot and the second and subsequent ingots after replacing the wire.

Further, according to the present invention, there is provided a wire saw comprising: wire rows formed of a wire that is spirally wound between a plurality of wire guides and travels in an axial direction; ingot feeding means for pressing an ingot against the wire rows while holding the ingot; and a nozzle that supplies a working fluid to a contact portion of the ingot and the wire, the ingot being sliced into wafers by pressing the ingot against the wire rows by the ingot feeding means while supplying the working fluid to the contact portion of the ingot and the wire from the nozzle, wherein a ratio of a wire new line feed amount per unit time in slicing of a slicing start portion of a first ingot to that in slicing of a central portion of the same at the time of slicing the ingot after replacement of the wire is controlled to be ½ or less of the ratio at the time of slicing the second and subsequent ingots after the replacement of the wire.

With this arrangement, it is possible to suppress a variation in thickness unevenness of wafers sliced out from the first ingot and the second and subsequent ingots after replacing the wire.

Advantageous Effects of Invention

According to the slicing method and the wire saw of the present invention, the thickness unevenness intrinsic to wafers sliced out from the first ingot after replacing the wire can be set to the same level as the thickness unevenness of wafers sliced out from the second and subsequent ingots. Consequently, processing conditions in, e.g., a lapping step which is a post-process can be uniformed, and productivity can be improved.

DESCRIPTION OF EMBODIMENTS

Although an embodiment according to the present invention will now be described hereinafter, the present invention is not restricted thereto.

As described above, a difference in thickness unevenness becomes considerable between wafers sliced out from a first ingot and wafers sliced out from second and subsequent ingots after replacing a wire due to a difference between wire diameters of the wires at slicing start portions in particular. If there is a variation in thickness unevenness between slicing lots (first slicing, and second and subsequent slicing), a necessary removal stock in a post-process such as a lapping step which is required to remove the thickness unevenness differs depending on each lot, thus leading to a demerit that processing conditions cannot be uniformed. Thus, the present inventor has conceived that the variation in thickness unevenness between the slicing lots can be suppressed by decreasing a wire new line feed amount in the slicing start portion of the first ingot after replacing the wire and further abrading the wire during slicing to reduce its wire diameter, thereby bringing the present invention to completion.

A wire saw according to the present invention will be first described with reference to FIG. 1 and FIG. 2.

Figure 1:
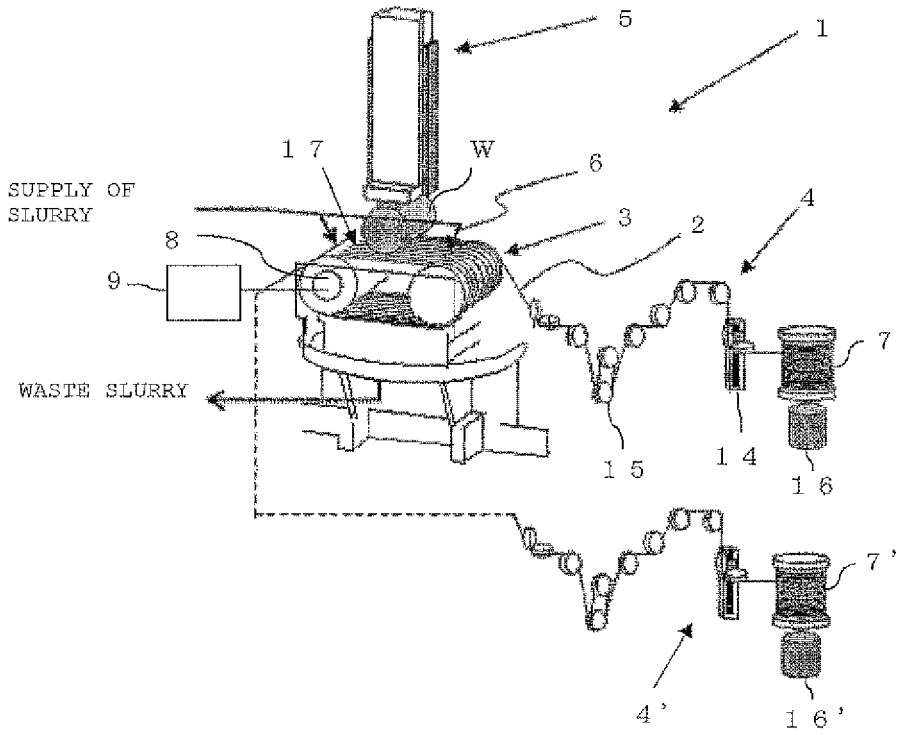
FIG. 1 is a schematic view showing an example of a wire saw according to the present invention.

As shown in FIG. 1, the wire saw 1 according to the present invention is mainly constituted of a wire 2 configured to slice an ingot W, a wire guide 3, wire tension imparting mechanisms 4 and 4' configured to impart tension to the wire 2, ingot feeding means 5 for relatively pushing down the ingot W while holding the same, a nozzle 6 configured to supply a working fluid to the wire 2 at the time of slicing, and others.

The wire 2 is reeled out from one wire reel 7, and enters the wire guide 3 through a traverser 14 and the wire tension imparting mechanism 4 formed of a powder clutch (a constant torque motor 15), a dancer roller (a dead weight) (not shown), and others. Wire rows 17 are formed by winding the wire 2 around the wire guide 3 for approximately 300 to 400 times. The wire 2 is taken up by a wire reel 7' through the other wire tension imparting mechanism 4'. As this wire, for example, a high tensile steel wire or the like can be used. The wire reels 7 and 7' are driven to rotate by wire reel drive motors 16 and 16'. Further, the tension applied to the wire 2 is precisely adjusted by the tension imparting mechanisms 4 and 4'.

The nozzle 6 supplies the working fluid to a contact portion of the ingot W and the wire 2. This nozzle 6 is not restricted in particular, and it can be arranged above the wire 2 wound around the wire guide 3. The nozzle 6 is connected to a slurry tank (not shown), and it is assumed that slurry to be supplied has its supply temperature controlled by a slurry chiller (not shown) and can be supplied from the nozzle 6 to the wire 2.

Here, a type of the working fluid used during slicing of the ingot W is not restricted in particular, one adopted in conventional examples can be used, and it can be provided by, e.g., dispersing silicon carbide abrasive grains or diamond grains in a coolant. As the coolant, for example, a water-soluble or oil-based coolant can be used.

Figure 2:
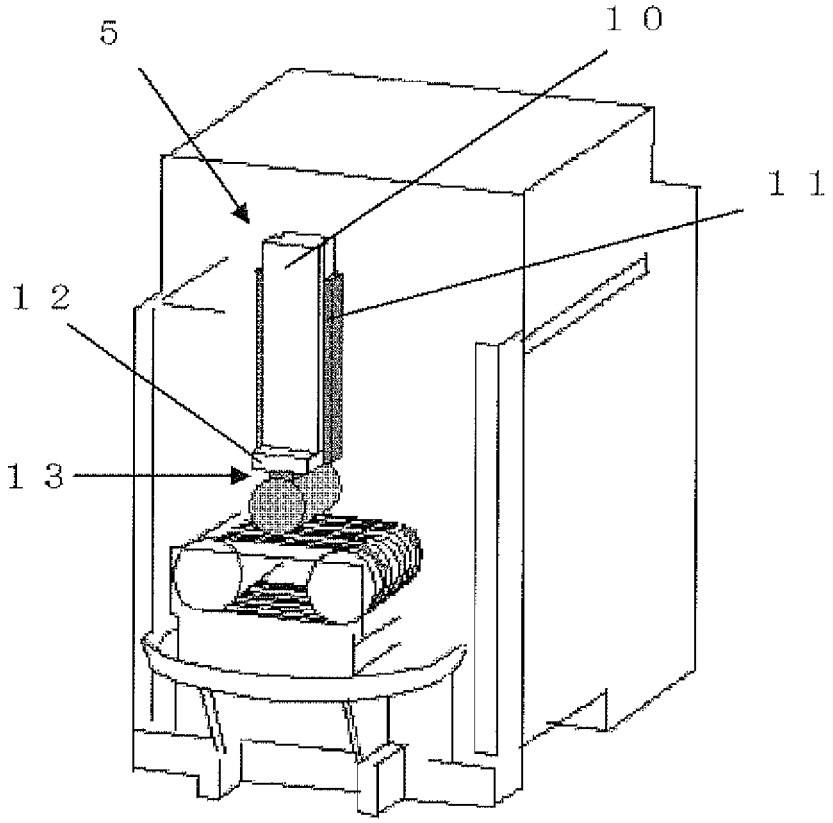
FIG. 2 is a schematic view showing an example of ingot feeding means.

At the time of slicing the ingot W, the ingot W is fed to the wire 2 wound around the wire guide 3 by such ingot feeding means 5 as shown in FIG. 2. This ingot feeding means 5 is constituted of an ingot feed table 10 configured to feed an ingot, an LM (Linear Motion) guide 11, an ingot clamp 12 that grips an ingot, a slicing backing pad 13, and others, and an ingot fixed at a tip can be fed at feed speed programmed in advance by driving the ingot feed table 10 along the LM guide 11 under computer control.

The wire guide 3 is a roller provided by press-fitting a polyurethane resin around a steel cylinder and forming grooves on a surface thereof at a fixed pitch, and it can prevent damage to the wire 2 and suppress wire breakage or the like. Furthermore, the wire guide 3 allows the wound wire 2 to travel and reciprocate in an axial direction by the drive motor 8. At the time of allowing the wire 2 to travel and reciprocate, travel distances of the wire 2 in both directions are not equally set, but the travel distance in one direction is set to be longer. When the wire travels and reciprocates in this manner, a new line is fed in a direction with the longer travel distance.

Furthermore, the wire saw according to the present invention includes controlling device 9 for controlling a wire new line feed amount at the time of slicing the ingot W as described below. This controlling device 9 performs control so that a ratio of a wire new line feed amount (a wire new line feed amount at the time of slicing a slicing start portion/a wire new line feed amount at the time of slicing a central portion) per unit time at the time of slicing the slicing start portion with respect to slicing the central portion of the ingot W when the first ingot W is sliced after replacing the wire 2 with a new wire becomes ½ or less of the ratio when the second or subsequent ingot W is sliced after replacing the wire 2. When this controlling device 9 is connected to, e.g., the drive motor B which is not restricted in particular, drive speed of the wire guide 3 can be controlled, and the wire new line feed amount can be changed in accordance with a slicing position of the ingot.

If this wire saw 1 according to the present invention is adopted, when the ratio at the time of slicing the slicing start portion of the first ingot W is set to ½ or less of the counterpart at the time of slicing the slicing start portion of the second or subsequent ingot W, the wire feed amount per unit time can be appropriately decreased, and abrasion of the wire 2 which is unused and has a large wire diameter can be advanced to reduce a wire diameter thereof. Consequently, it is possible to suppress an increase in difference between thickness unevenness of wafers sliced out from the first ingot W after replacing the wire 2 and thickness unevenness of wafers sliced out from the second and subsequent ingots W. If a variation in thickness unevenness of the respective wafers is small, the processing conditions in a lapping step and others can be uniformed, and productivity in a post-process can be improved.

A method for slicing an ingot according to the present invention will now be described. Here, an example using such a wire saw 1 as shown in FIG. 1 will be described.

First, in the wire saw 1, a wire is placed with the new wire 2 that has not been used for slicing. Then, the first ingot W to be sliced after the replacement of the wire 2 is prepared. Subsequently, the ingot W is held by the ingot feeding means 5. Furthermore, the wire 2 is allowed to travel along the axial direction in a reciprocating manner by the drive motor 8 while imparting the tension to the wire 2 by the tension imparting mechanisms 4 and 4'.

Then, the ingot W is relatively pushed down by the ingot feeding means 5, the ingot W is pressed against the wire rows 17, and slicing of the first ingot W is started. At the time of slicing the ingot W, slicing is advanced while supplying a working fluid to the contact portion of the ingot W and the wire 2 from the nozzle 6.

At this time, a ratio of a wire new line feed amount per unit time at the time of slicing a slicing start portion to that at the time of slicing a central portion of the first ingot W is controlled to become ½ or less of the above-described ratio at the time of slicing the second or subsequent ingot W. The respective wire new line feed amounts (e.g., the wire new line feed amounts at the time of slicing the slicing start portions or the central portions of the first ingot or the second and subsequent ingots) can be appropriately set based on slicing conditions (e.g., a material, a diameter, and others of each ingot to be sliced).

The ingot is further pushed down while performing the control and slicing is advanced to complete the slicing, then the ingot W that has been sliced is extracted from the wire rows 17 by reversing a feed direction of the ingot W, and sliced wafers are collected. Moreover, the second and subsequent ingots W are prepared, and the slicing is carried out by the same procedure. At this time, in the slicing of the second and subsequent ingots, the ratio is set to be two times or more to that of the first ingot.

As described above, the plurality of ingots W are sequentially and repeatedly sliced into wafers by using the replaced new wire 2.

According to such a slicing method, when the ratio at the time of slicing the slicing start portion of the first ingot W is set to ½ or less of the ratio at the time of slicing the slicing start portion of each of the second and subsequent ingots W, the wire feed amount per unit time can be appropriately reduced, and abrasion of the wire 2 which still has a large wire diameter in an unused state can be advanced to decrease the wire diameter. Consequently, it is possible to suppress an increase in difference between thickness unevenness of each wafer sliced out from the first ingot W and thickness unevenness of each wafer sliced out from the second and subsequent ingots W after the replacement of the wire 2. If a variation in thickness unevenness of each wafer is small, the processing conditions in a lapping step or the like can be uniformed, and productivity in a post process can be improved.

EXAMPLES

Although the present invention will now be more specifically described based on examples and a comparative example, the present invention is not restricted thereto.

Example 1

In such a wire saw according to the present invention as shown in FIG. 1, a wire is replaced with a new wire, and then slicing of a plurality of ingots was repeatedly carried out in accordance with the slicing method of the present invention.

Thickness unevenness of each wafer sliced out from each ingot was measured, and an average of the thickness unevenness of each wafer sliced out from each ingot was calculated. It is to be noted that the thickness unevenness means a difference between a thickness of a slicing start portion and a thickness of a central portion within a wafer surface as described above.

In Example 1, a ratio of a wire new line feed amount per unit time in slicing of the slicing start potion to that in slicing of the central portion of the ingot at the time of slicing the first ingot after the replacement of the wire was set to 10%. Further, a ratio of the wire new line feed amount per unit time in slicing of the start portion to that in slicing of the central portion of the ingot at the time of slicing each of the second and subsequent ingots was set to 26%. That is, the ratio at the time of slicing the first ingot was controlled to become 10/26 of the ratio at the time of slicing each of the second and subsequent ingots.

Figure 3:
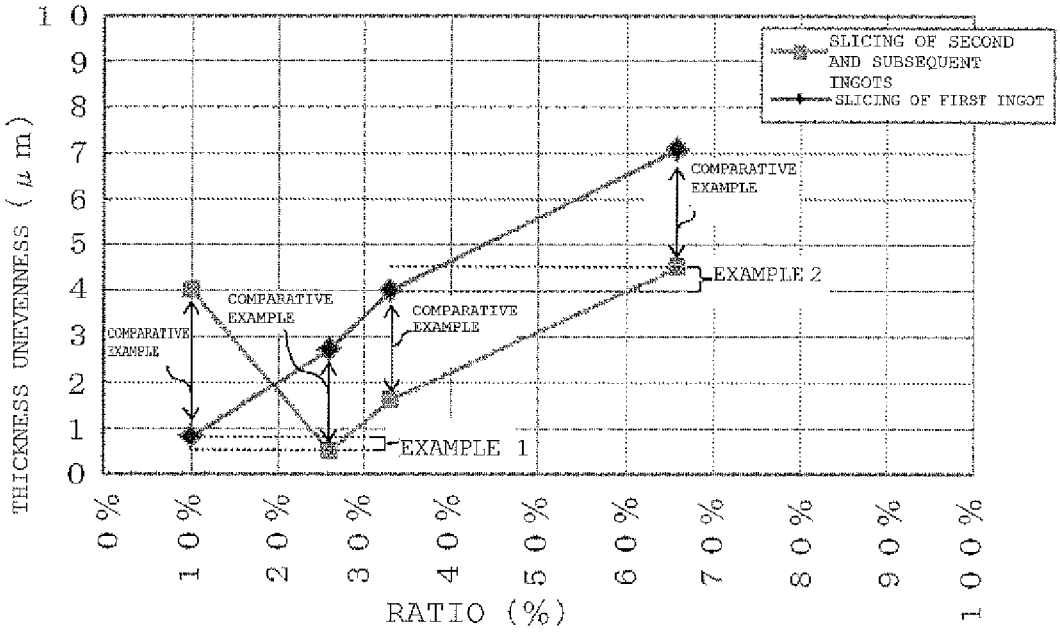
FIG. 3 is a view showing a relationship between thickness unevenness and a ratio of a wire new line feed amount per unit time in each of Examples 1 and 2 and Comparative Example.
Figure 4:
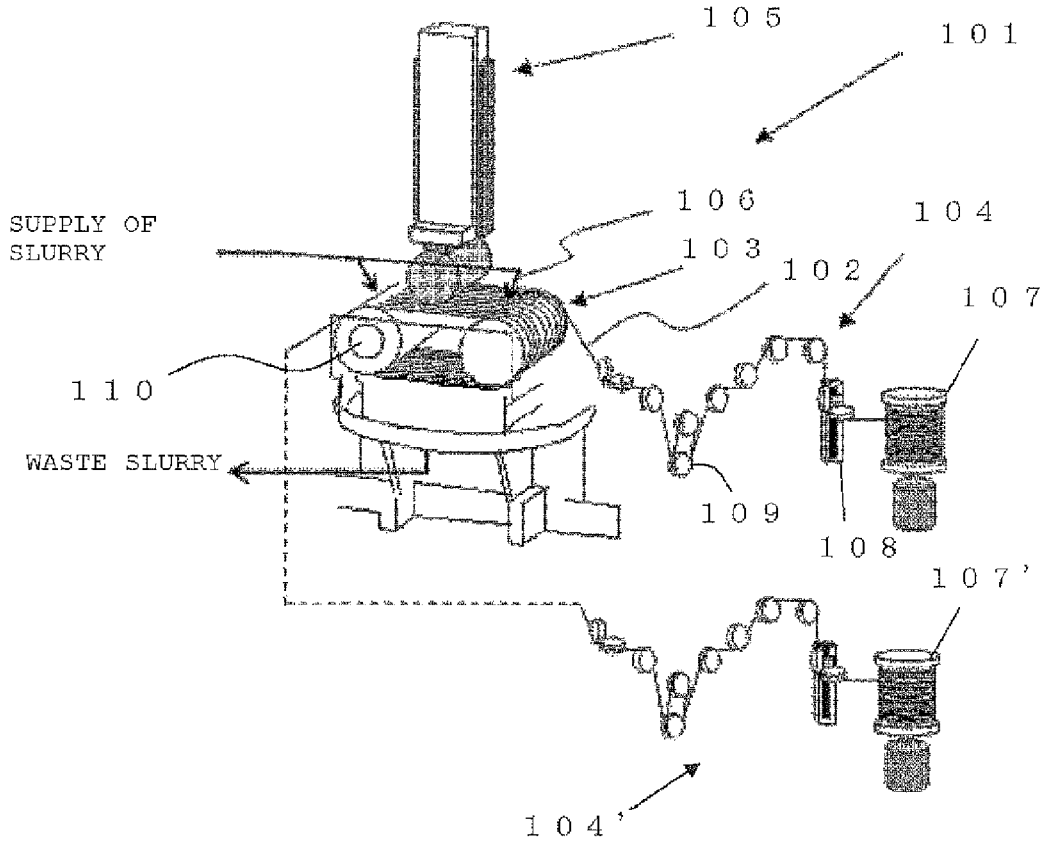
FIG. 4 is a schematic view showing an example of a wire saw used in a conventional slicing method.

FIG. 3 and Table 1 show a result. An axis of ordinate of a graph in FIG. 3 represents thickness unevenness, and an axis of abscissa represents a ratio of the wire new line feed amount per unit time in the slicing of the slicing start portion to that in the slicing of the central portion of the ingot. As shown in Table 1, an average of the thickness unevenness of the wafers sliced out from the first ingot was 0.8 μm. Furthermore, an average of thickness unevenness of the wafers sliced out from the second and subsequent ingots was 0.5 μm. Therefore, a thickness unevenness difference was 0.3 μm, and it was confirmed that a variation in thickness unevenness was considerably reduced as compared with a later-described comparative example.

Example 2

Ingots were repeatedly sliced under the same conditions as those of Example 1 except that the ratio at the time of slicing a first ingot after replacement of a wire was set to 33% and the ratio at the time of slicing second and subsequent ingots was set to 66%. That is, the ratio at the time of slicing the first ingot was ½ of the ratio at the time of slicing the second and subsequent ingots.

After completion of the slicing of the ingots, thickness unevenness was measured by the same method as Example 1, and averages were calculated.

Consequently, as shown in FIG. 3 and Table 1, an average of thickness unevenness of wafers sliced out from the first ingot was 4.0 μm. Moreover, an average of thickness unevenness of wafers sliced out from the second and subsequent ingots was 4.5 μm. Thus, a thickness unevenness difference was 0.5 μm, and it was confirmed that a variation in thickness unevenness was considerably reduced like Example 1.

Comparative Example

Ingots were repeatedly sliced under the same conditions as those of Example 2 except that the ratios at the time of slicing a first ingot and at the time of slicing second and subsequent ingots after replacement of a wire were set to the same value. First, the ratios at the time of slicing the first ingot and at the time of slicing the second and subsequent ingots after the replacement of the wire were set to 66%.

After completion of the slicing of the ingots, thickness unevenness was measured by the same method as Example 1, and averages were calculated.

Consequently, as shown in FIG. 3 and Table 1, a thickness unevenness difference between wafers sliced out from the first ingot and the second and subsequent ingots was 2.6 μm, and it was confirmed that a variation in thickness unevenness was increased as compared with Examples 1 and 2.

Additionally, as a result of likewise repeating the slicing while setting the ratio to 33%, 26% m and 10%, thickness unevenness differences were 2.4 μm, 2.2 μm, and 3.2 μm respectively, and it was confirmed that a variation in thickness unevenness was increased as compared with Examples 1 and 2.

Table 1 shows a summary of implementation results of Examples and Comparative Example.

TABLE 1

| | Second and subsequent ingots | | Slicing of first ingot | | Difference in thickness unevenness between first ingot and |
|---|---|---|---|---|---|
| | Ratio (%) | Thickness unevenness (μm) | Ratio (%) | Thickness unevenness (μm) | second and subsequent ingots (μm) |
| Comparative example | 66% | 4.5 | 66% | 7.1 | 2.6 |
| | 33% | 1.6 | 33% | 4.0 | 2.4 |
| | 26% | 0.5 | 26% | 2.7 | 2.2 |
| | 10% | 4.0 | 10% | 0.8 | 3.2 |
| Example 2 | 66% | 4.5 | 33% | 4.0 | 0.5 |
| Example 1 | 26% | 0.5 | 10% | 0.8 | 0.3 |

It is to be noted that the present invention is not restricted to the foregoing embodiments. The foregoing embodiments are illustrations, and any example that has substantially the same configuration and exercises the same functions and effects as the technical concept described in claims of the present invention is included in the technical scope of the present invention.

The invention claimed is:

1. A method for slicing an ingot by which wire rows are formed by using a wire that is spirally wound between a plurality of wire guides and travels in an axial direction, and an ingot is pressed against the wire rows while supplying a working fluid to a contact portion of the ingot and the wire, thereby slicing the ingot into wafers, wherein a ratio of a wire new line feed amount per unit time in slicing of a slicing start portion of a first ingot to that in slicing of a centration portion of the same at the time of slicing the ingot after replacement of the wire is controlled to be ½ or less of the ratio at the time of slicing second and subsequent ingots after the replacement of the wire.

2. A wire saw comprising: wire rows formed of a wire that is spirally wound between wire guides and travels in an axial direction; ingot feeding means for pressing an ingot against the wire rows while holding the ingot; and a nozzle that supplies a working fluid to a contact portion of the ingot and the wire, the ingot being sliced into wafers by pressing the ingot against the wire rows by the ingot feeding means while supplying the working fluid to the contact portion of the ingot and the wire from the nozzle, wherein a ratio of a wire new line feed amount per unit time in slicing of a slicing start portion of a first ingot to that in slicing of a central portion of the same at the time of slicing the ingot after replacement of the wire is controlled to be ½ or less of the ratio at the time of slicing the second and subsequent ingots after the replacement of the wire.

* * * * *